US006378988B1

(12) United States Patent
Taylor et al.

(10) Patent No.: US 6,378,988 B1
(45) Date of Patent: Apr. 30, 2002

(54) CARTRIDGE ELEMENT FOR MICRO JET DISPENSING

(75) Inventors: David W. Taylor, Richardson; Ioan Achiriloaie, Dallas, both of TX (US)

(73) Assignee: MicroFab Technologies, Inc., Plano, TX (US)

( * ) Notice: Subject to any disclaimer, the term of this patent is extended or adjusted under 35 U.S.C. 154(b) by 0 days.

(21) Appl. No.: 09/812,395

(22) Filed: Mar. 19, 2001

(51) Int. Cl.[7] ..... B41J 2/205
(52) U.S. Cl. ..... 347/49; 347/50
(58) Field of Search ..... 347/12, 49, 50, 347/86, 87, 85, 68; 439/559; 427/162

(56) References Cited

U.S. PATENT DOCUMENTS

| | | | | | |
|---|---|---|---|---|---|
| 3,683,212 | A | | 8/1972 | Zoltan | 310/8.3 |
| 4,418,354 | A | | 11/1983 | Perduijn | 347/68 |
| 4,887,100 | A | | 12/1989 | Michaelis et al. | 347/69 |
| 5,053,100 | A | | 10/1991 | Hayes et al. | 156/204 |
| 5,092,864 | A | | 3/1992 | Hayes et al. | 606/10 |
| 5,365,645 | A | | 11/1994 | Walker et al. | 29/25.35 |
| 5,414,916 | A | | 5/1995 | Hayes | 29/25.35 |
| 5,444,467 | A | * | 8/1995 | Stortz | 347/12 |
| 5,658,802 | A | | 8/1997 | Hayes et al. | 436/518 |
| 5,681,757 | A | | 10/1997 | Hayes | 437/7 |
| 5,707,684 | A | * | 1/1998 | Hayes et al. | 427/162 |
| 6,139,361 | A | * | 10/2000 | Przilas et al. | 439/559 |
| 6,188,416 | B1 | | 2/2001 | Hayes | 347/71 |

* cited by examiner

*Primary Examiner*—Anh T. N. Vo
(74) *Attorney, Agent, or Firm*—Locke Liddell & Sapp LLP

(57) ABSTRACT

A completely self-contained replaceable cartridge for micro jet dispensing assemblies is thinner than the spacing between a standard "DIP" socket. Each cartridge body contains a preferably embedded digitally operated micro jet piezoelectric ejector, a tubular capillary reservoir and fixed connecting pins spaced to removably plug into a standard dual in line packaging (DIP) socket strip or board to receive digital ejection signals. A plurality of the individual replaceable cartridges can be closely positioned together in "banks" which plug into standard DIP sockets. One or more "banks" can be plugged into sockets on a housing containing a chamber into which the micro-droplets are deposited. An air movement device may be included with the housing to disperse volatile material that has been ejected into the chamber. The chamber preferably contains a heatable surface onto which the volatile fluids are ejected from the orifices and whereby instantaneous volatilization of the fluid will take place. In an alternate embodiment, each self-contained replaceable cartridge has its own individual heatable surface in the form of a heater mounted adjacent the ejection orifice and one or more additional connecting pins to provide power to operate the heater. A multiplicity of different volatile fluids may be dispensed from a compact assembly in response to command signals from a controller connected to the dispensing assembly.

30 Claims, 6 Drawing Sheets

CARTRIDGE ELEMENT FOR MICRO JET DISPENSING

BACKGROUND OF THE INVENTION

1. Field of the Invention

The present invention lies in the field of self-contained micro jet fluid droplet dispensers.

2. Background of the Prior Art

Ink jet printing devices are well known in the art. Some U.S. patents which have discussed various ink jet printing devices are U.S. Pat. Nos. 5,299,016, 5,681,757, 6,029,896, 5,658,802 and 5,444,467 which are incorporated herein by reference. Such devices are preferably digitally operated. Ink jet printing devices function by transforming electrical inputs to mechanical outputs, which in a proper device produces fluid micro-droplets from tiny orifices.

Specialized devices primarily utilizing the properties of piezoelectric materials include applying micro-droplets of liquid dye for improved laser surgery (U.S. Pat. No. 5,092, 864); producing micro-optical components from polymeric materials (U.S. Pat. No. 5,498,444); distributing epoxy die-bond adhesive using a printhead and a micro jet array of printheads (U.S. Pat. No. 5,681,757); applying various reagents in miniaturized diagnostic arrays (U.S. Pat. No. 5,658,802); producing microlenses (U.S. Pat. No. 5,707, 684); and with the aid of a specialized printhead, depositing liquid solder onto a substrate (U.S. Pat. No. 5,772,106).

High density ink jet printheads are shown in U.S. Pat. Nos. 5,365,645, 5,227,813 and 5,235,352. Most people are familiar with the self-contained ink jet cartridges used in their ink-jet printers. Though small, these cartridges are still somewhat bulky. They contain contacts, a digitally driven generally piezoelectric ejection device or a plurality of ejection devices and individual reservoirs connected to the ejection devices, all contained in a housing.

SUMMARY OF THE INVENTION

A self-contained replaceable cartridge for micro jet dispensing assemblies has a cartridge body comprising a thin panel having opposed side surfaces substantially larger than the thickness of the cartridge body and an outwardly facing peripheral edge. A digitally operated micro-droplet ejection device having an outwardly facing ejection orifice is carried by the cartridge body and preferably embedded therein. In fluid communication with the ejection device is an elongated tubular fluid reservoir also carried by the cartridge body and preferably embedded in a channel formed in the side surface of the cartridge body. The elongated tubular fluid reservoir is preferably in the form of an elongated capillary tube disposed in a channel which has a serpentine form.

Digital operating signals for the micro-droplet ejection device are provided by a pair fixed connecting pins mounted in the body. Each connecting pin extends from the body and is configured for engagement and disengagement with one of the pair of dual in line sockets in a conventional connector strip having a plurality of closely spaced dual in line sockets. The connecting pins of the cartridge can be quickly plugged into and unplugged from any one of the pair of closely spaced dual in line sockets which receive the connecting pins and support the cartridge to make a closely packed assembly of individually replaceable dispensers.

In an alternate embodiment, each self-contained replaceable cartridge has a heater supported by the cartridge body in front of and spaced from the ejection orifice. The heater is mounted to the cartridge body by means of a stand-off strip adjacent to the ejection orifice and is preferably narrower than the thickness of the panel comprising the cartridge body. A connecting pin mounted in the cartridge body and fixed thereto is connected to the heater by means of a depressed wiring channel in the side surface of the panel. The additional fixed connecting pin embedded in the body provides electrical power for operation of the heater. All of the digitally operated ejection device, the tubular reservoir, the connecting pins and the wiring are preferably depressed in openings or channels below the level of the side surface of the body. This prevents parts of the replaceable cartridges from interfering with each other when they are placed in closely packed assemblies in the form of "banks" of self-contained replaceable cartridges which may be installed and replaced simply by plugging them into the connecting sockets or unplugging them from the sockets.

One or more banks having a plurality of the self-contained replaceable cartridges can be removably mounted onto connecting strips on a housing containing a chamber which forms a multi-fluid dispensing device. The chamber preferably includes a heatable surface with the ejection orifices positioned to deposit ejected micro-droplets onto the heated surface for rapid volatilization of any one or more of a plurality of fluids contained in the replaceable cartridges. A preferred embodiment has two banks of the self-contained replaceable cartridges having ejection orifices arranged to eject micro-droplets into the chamber and/or onto the heatable surface. Each of the banks of replaceable cartridges are separated and positioned in a radial orientation with respect to the chamber. The housing preferably has an air movement device and a passageway which allows air to traverse the chamber and exit the dispensing assembly device through an outlet where the volatilized fluid can be sensed by a user.

The self-contained replaceable cartridges of the invention are uniquely suitable for dispensing fluid materials or combinations of materials which generate odors, fragrances or aromas for sensing. Each cartridge element has a simple integrated construction for one fluid dispensing. Virtually an unlimited number of the cartridge elements may be assembled to make a complex dispensing cartridge assembly with multi-fluid capabilities. Maintenance of such an assembly is easy because individual cartridges are easily replaced or changed and may be refilled. The fluid in each replaceable cartridge is independent of the fluid in any other cartridge and there is little or no contamination between fluids. The design is sturdy and highly reliable and may be operated in any orientation.

DETAILED DESCRIPTION OF THE PREFERRED EMBODIMENT

Figure 1:
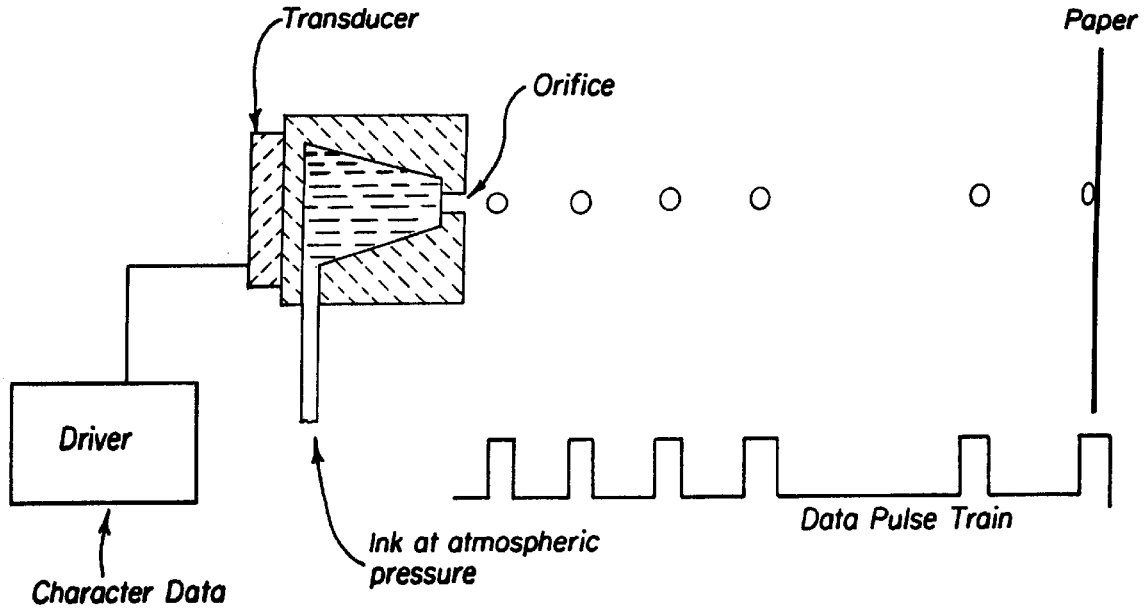
FIG. 1 is a schematic representation of a digitally operated transducer operating to produce micro-droplets in drop-in-demand mode.

The present invention discloses a specialized, replaceable, "plug-and-play" cartridge or assembly of cartridges which preferably utilize drop-on-demand ink-jet technology. In piezoelectric-based, drop-on-demand ink-jet printing systems, illustrated schematically in FIG. 1, a volumetric change in the fluid within a printing device is induced by the application of a voltage pulse to a piezoelectric transducer which is mechanically coupled to the fluid. The volumetric change in the transducer causes pressure/velocity transients to occur in the fluid which are directed in a way which produces a drop of fluid from the orifice of the device. Here a voltage pulse is applied only when a drop is desired, as opposed to continuous ink-jet printers where droplets are continuously produced, but directed to the target substrate only when needed by a charge and deflect method. Further details about ink-jet printing systems and control apparatus is found in U.S. Pat. Nos. 5,498,444 and 5,707,684 which are incorporated herein by reference. In the Figures that follow, a preferred replaceable cartridge of the invention will be generally designated by the reference numeral 10 as shown in FIG. 3.

Figures 2, 2A:
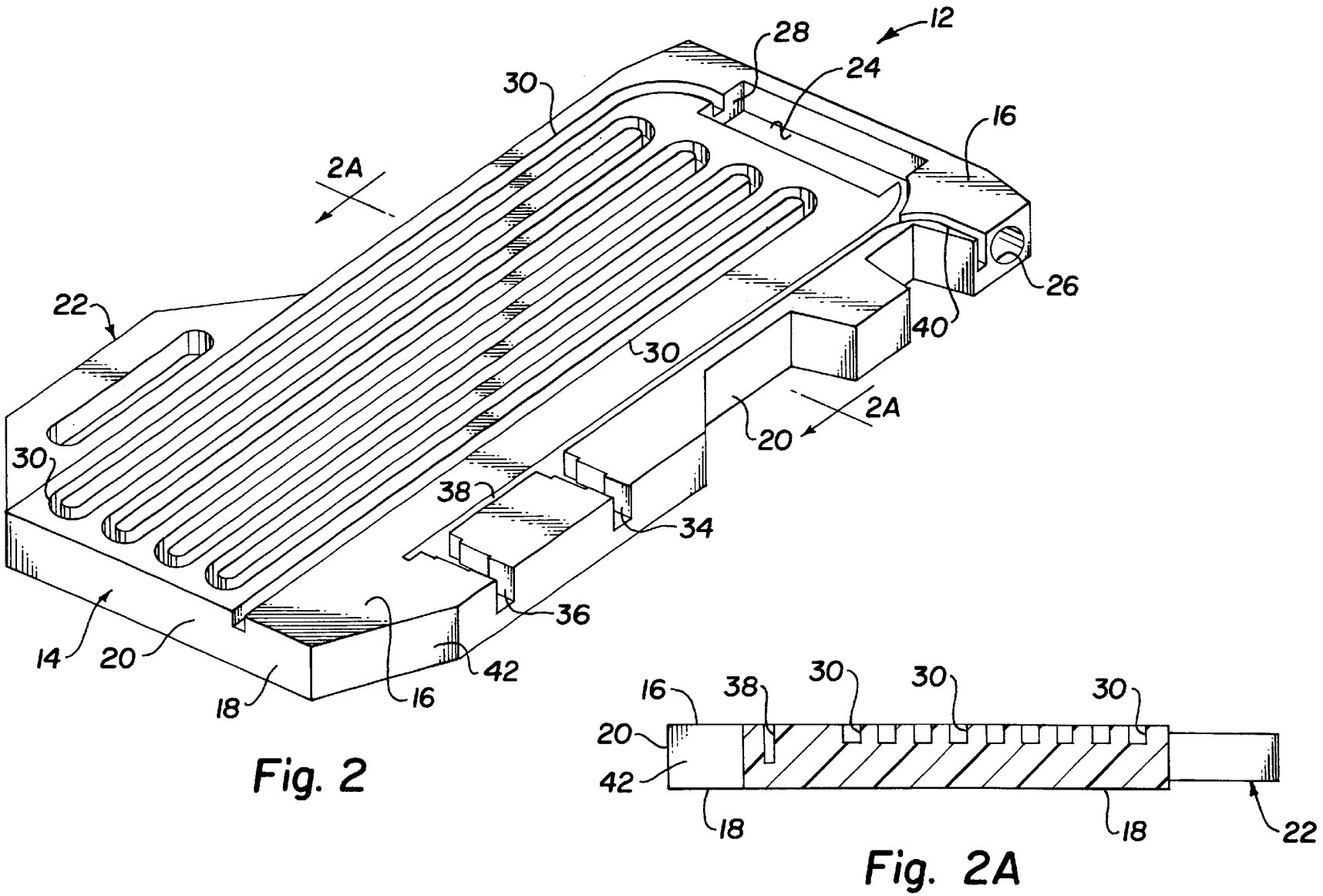
FIG. 2 is a perspective view of a cartridge body used to make the replaceable cartridge for micro jet dispensing assemblies of the present invention.
FIG. 2*a* is a cross section of the cartridge body of FIG. 2 on the lines 2*a*—2*a* of FIG. 2.
Figure 3:
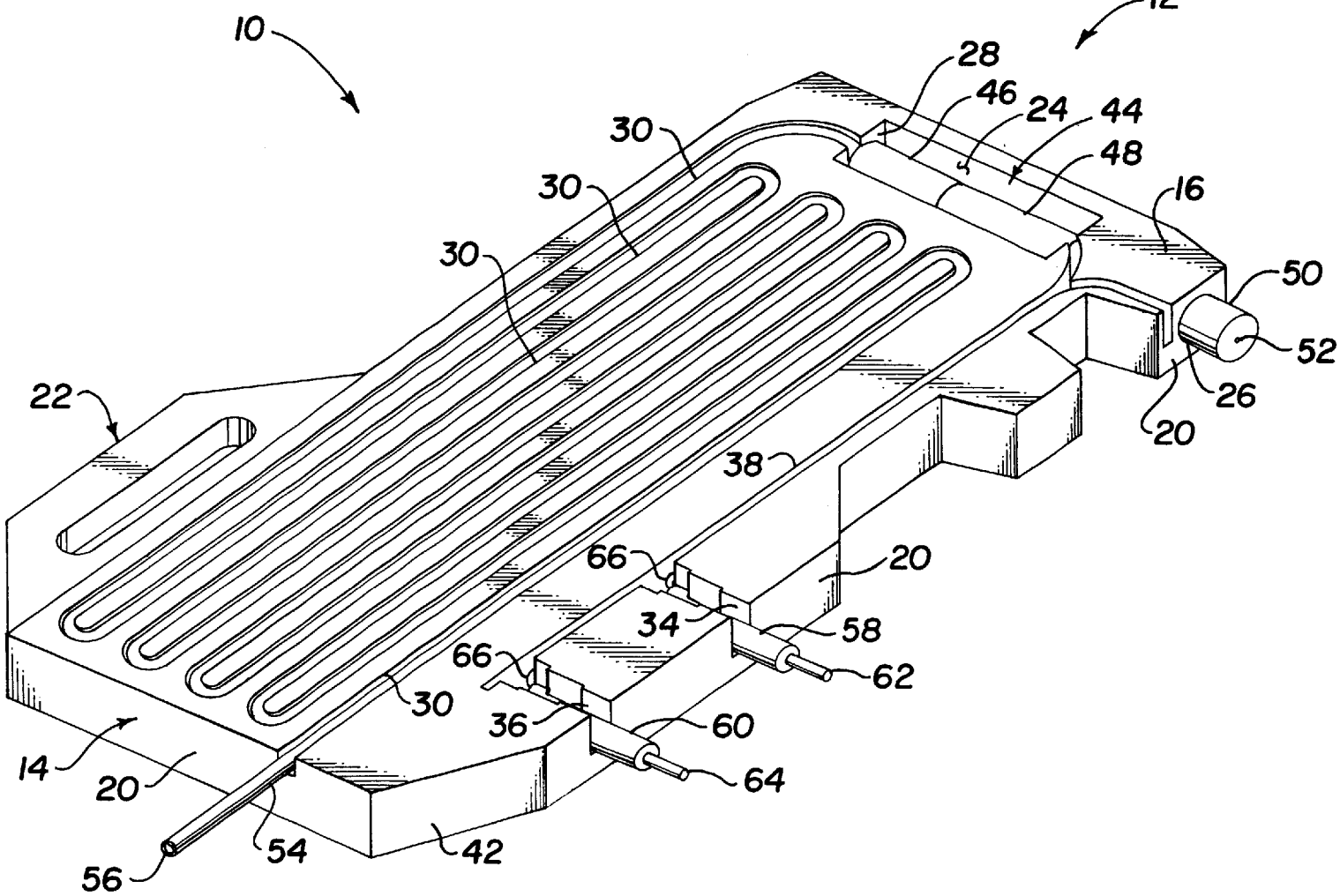
FIG. 3 is a perspective view of the cartridge body of FIG. 2 further containing an elongated tubular fluid reservoir, a micro-droplet ejection device and a pair of fixed connecting pins in electrical contact with the ejection device.

FIG. 2 shows the cartridge body 12 for the replaceable cartridge 10 of FIG. 3. Cartridge body 12 comprises a thin panel 14 having opposed side surfaces 16 and 18 substantially larger than the thickness of the panel 14. Side surface 16 is the top or upper surface and side surface 18 is the bottom surface more clearly seen in FIG. 2*a*. Side surfaces 16, 18 together define an outwardly facing peripheral edge 20 extending around the body panel 14. Body panel 14 is preferably provided with a handle 22 which is thinner than the thin panel 14 to make it more accessible for grasping and handling. Various operating parts are preferably embedded in the side surface of the cartridge body. Embedded in this context connotes a channel or depressed opening which provides an interference fit between the part and the channel or opening that tends to hold the part in place. The term is broad enough to include an adhesive or substance which fills part or all of the space around the part and may be used in place of or in addition to frictional holding forces.

Cartridge body 12 is preferably molded with certain depressions in one or both of the side surfaces which makes possible a self-contained replaceable cartridge 10. Body 12 has an ejection device opening 24 formed in side surface 16 and an opening 26 in outwardly facing peripheral edge 20 for the tip portion of the ejection device. Leading into the back end 28 of opening 24 is a tubular and serpentine channel 30 depressed below surface 16 and occupying a considerable portion of the area of side surface 16. Channel 30 will be used to embed a tubular reservoir in cartridge body 12 below surface 16. Channel 30 is seen in cross section in FIG. 2*a*. Finally, surface 16 of body 12 has a depressed opening 34 and a depressed opening 36 which are configured to receive connecting pins to make electrical connections with pairs of dual in line sockets in a connector strip. Behind openings 34, 36 runs a wiring channel 38 which extends to ejection device opening 24 and has branches 40, 41 for purposes which will be seen later. Body 12 may have a truncated corner portion 42 for handling.

The replaceable cartridge 10 for micro jet dispensing assemblies is shown in FIG. 3. A digitally operated micro-droplet ejection device 44 is embedded in opening 24 of cartridge body 12 below surface 16. Ejection device 44 has a connection end 46 and an ejection end 48 ahead of connection end 46. A tip portion 50 of ejection end 48 is positioned in opening 26 extending from outwardly facing peripheral edge portion 20. The outer end of tip portion 50 of ejection end 48 terminates in ejection orifice 52. An elongated tubular reservoir 54 is embedded in channel 30 below surface 16. Tubular reservoir 54 has an open fill opening 56. The other end of reservoir 54 enters opening 24 through its back end 28 where it is coupled in fluid communication with the connection end 46 of ejection device 44. A pair of fixed connecting pins 58 and 60 are embedded respectively in depressed openings 34 and 36 in body 12. Connecting pin 58 has a pin connector 62 and connecting pin 60 has a pin connector 64. The pin connectors 62, 64 are in electrical contact with ejection device 44 through suitable wires 66 running in channel 38 below surface 16. All of the operating parts are carried by the body 12 and preferably embedded below the surface 16 to make the thin compact self-contained replaceable cartridge 10. The openings in side 16 may be filled with a suitable material, such as epoxy or covered with a thin cover to contain them.

Figure 4:
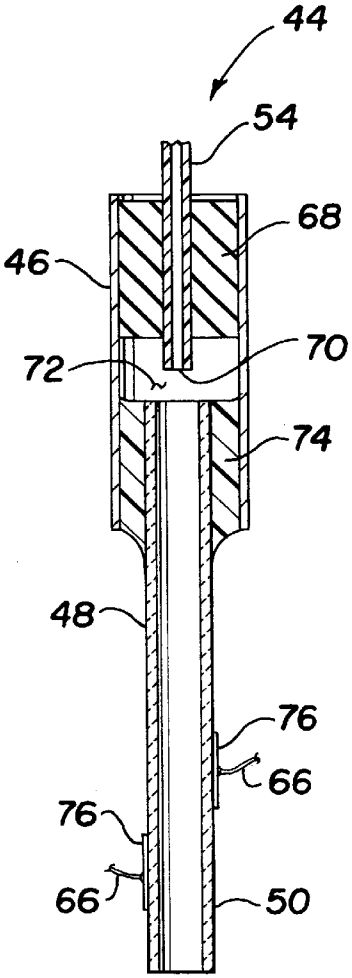
FIG. 4 is a cross section of a digitally operated micro-droplet ejection device carried by the cartridge body in FIGS. 3 and 5.

FIG. 4 is an enlarged view in cross section of micro jet droplet ejection device 44. Ejection device 44 has its connection end 46 connected to elongated tubular reservoir 54 by means of a rubber plug 68 or other suitable means. The open end 70 of reservoir 54 leads into a fluid chamber 72 in fluid communication with the interior of ejection end 48. Ejection end 48 is preferably piezoelectric material having is back end adhesively connected with connection end 46 by suitable means such as adhesive 74. End 48 is provided with suitable electrical connections through thin film metallic layers connected to contacts 76 and wires 66 to connecting pins 58, 60. The thin film metallic layers cannot be seen. Ejection orifice 52 in the projecting end portion 50 cannot be seen because this view is a cross section.

Figure 5:
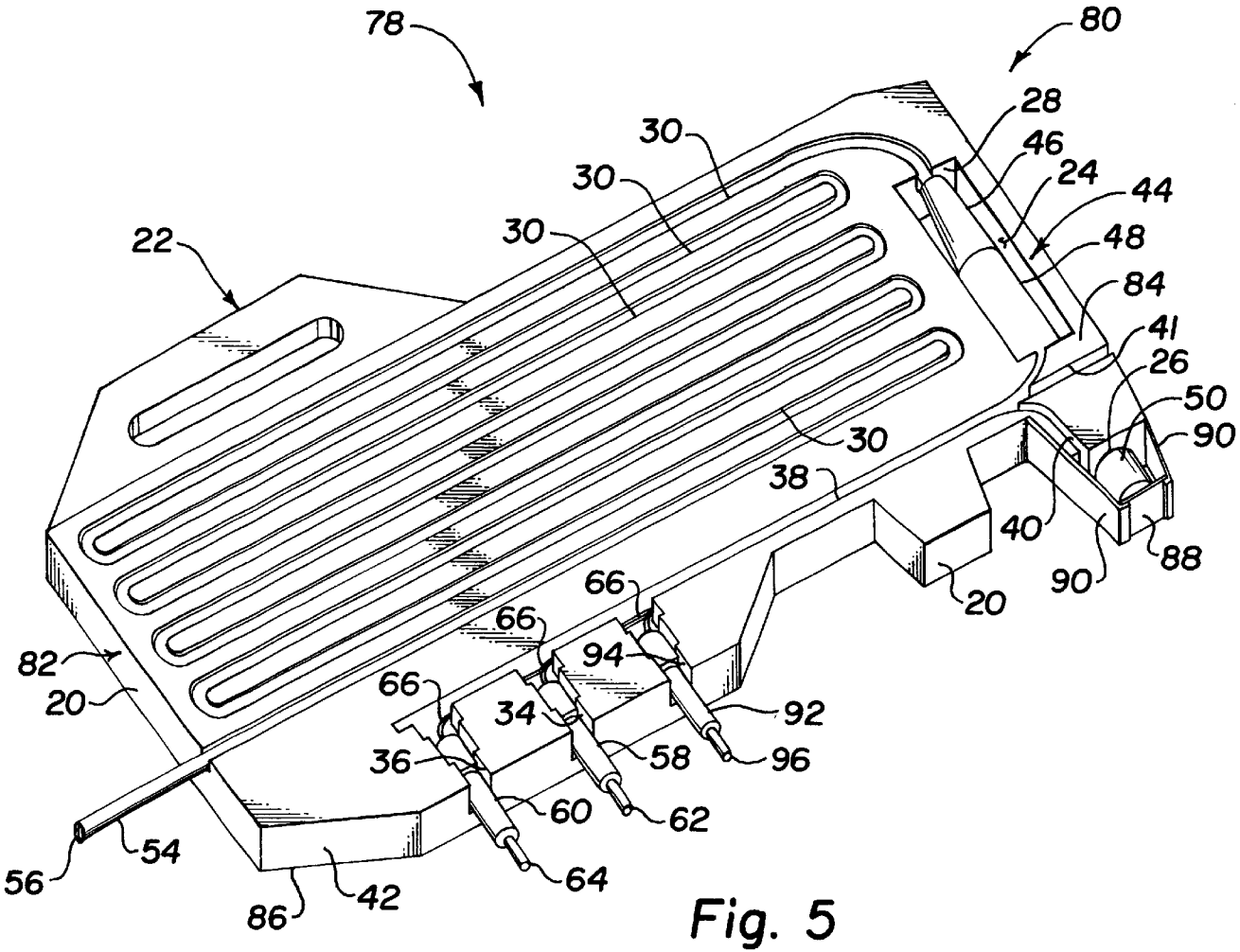
FIG. 5 is a perspective view of a modification of the replaceable cartridge of FIG. 3 further including a heating device spaced apart from and in line with the ejection orifice of the ejection device with an additional fixed connecting pin for the heater.

A modified replaceable cartridge 78 having all of the features of replaceable cartridge 10 is shown in FIG. 5. Cartridge body 80, like cartridge body 12, comprises a thin panel 82 like panel 14 having opposed side surfaces 84, 86 substantially larger than the thickness of panel 82. Side surface 84 is the top or upper surface and side surface 86 is the bottom surface of thin panel 82. Side surfaces 84, 86 together define an outwardly facing peripheral edge 20 extending around body panel 82. Body panel 82 is provided with a handle 22 which is thinner than panel 82 to make it more accessible for grasping and handling. Cartridge body 80 is molded with depressions in one or both side surfaces in the same way as cartridge body 12. Cartridge body 80 has the same ejection device opening 24 having the same ejection device 44 embedded therein below surface 84.

A tip portion 50 of ejection end 48 is positioned in the opening 26 extending from peripheral edge portion 20 and terminating in the ejection orifice 52 which is hidden in FIG.

5. Leading into back end 28 of opening 24 is a tubular serpentine channel 30 depressed below surface 84 and occupying a considerable portion of area of side surface 84. Elongated tubular reservoir 54 is embedded in channel 30 below surface 84. Fill opening 56 is seen extending from peripheral edge portion 20 of panel 82. The other end of reservoir 54 enters opening 24 through back end 28 where it is coupled in fluid communication with the connection end 46 of ejection device 44. Cartridge 80 has the same pair of fixed connecting pins 58 and 60 embedded respectively in openings 34 and 36. The pin connectors 62 and 64 are in electrical contact with ejection device 44 through suitable wires 66 running in channel 38 below surface 84.

What is different about cartridge body 80 of replaceable cartridge 78 is the presence of a built in heater 88 supported by cartridge body 80 in front of and spaced from ejection orifice 52 by means of a stand off strip or strips 90. A third fixed connecting pin 92 is embedded in depressed opening 94 in side surface 84. Fixed connecting pin 92 has a pin connector 96 connected via wires 66, channel 38 and branches 40, 41 in electrical connection with heater 88 spaced in front of the ejection orifice. The fixed connecting pins are fixed to the cartridge body with the spacing preferably configured to fit into a pair of closely spaced dual in line sockets which receive the connecting pins and support the cartridge to make a close packed replaceable dispenser. The third connecting pin 92 can be spaced to fit a connecting strip having three in line closely spaced sockets or a separate connecting strip or some other connector means. Since one of the connecting pins 58, 60, 92 can effectively act as the ground for heater 88 and ejection device 44, it is only necessary to have three connecting pins to power up both electrical elements. If connecting pin 58 acts as the ground, its wire or wires 66 will connect to both ejection device 44 and heating element 88.

The modification of replaceable cartridge 78 makes it possible to provide banks of stand alone assemblies which have built in heaters to quickly vaporize micro-droplets which are ejected onto the surface of heater 88 when heater 88 is operated at an elevated temperature. A useful fluid for use in replaceable cartridges 10, 78 is a fluid which produces a fragrance or aroma for the user to experience when the fluid is volatilized.

Figure 6:
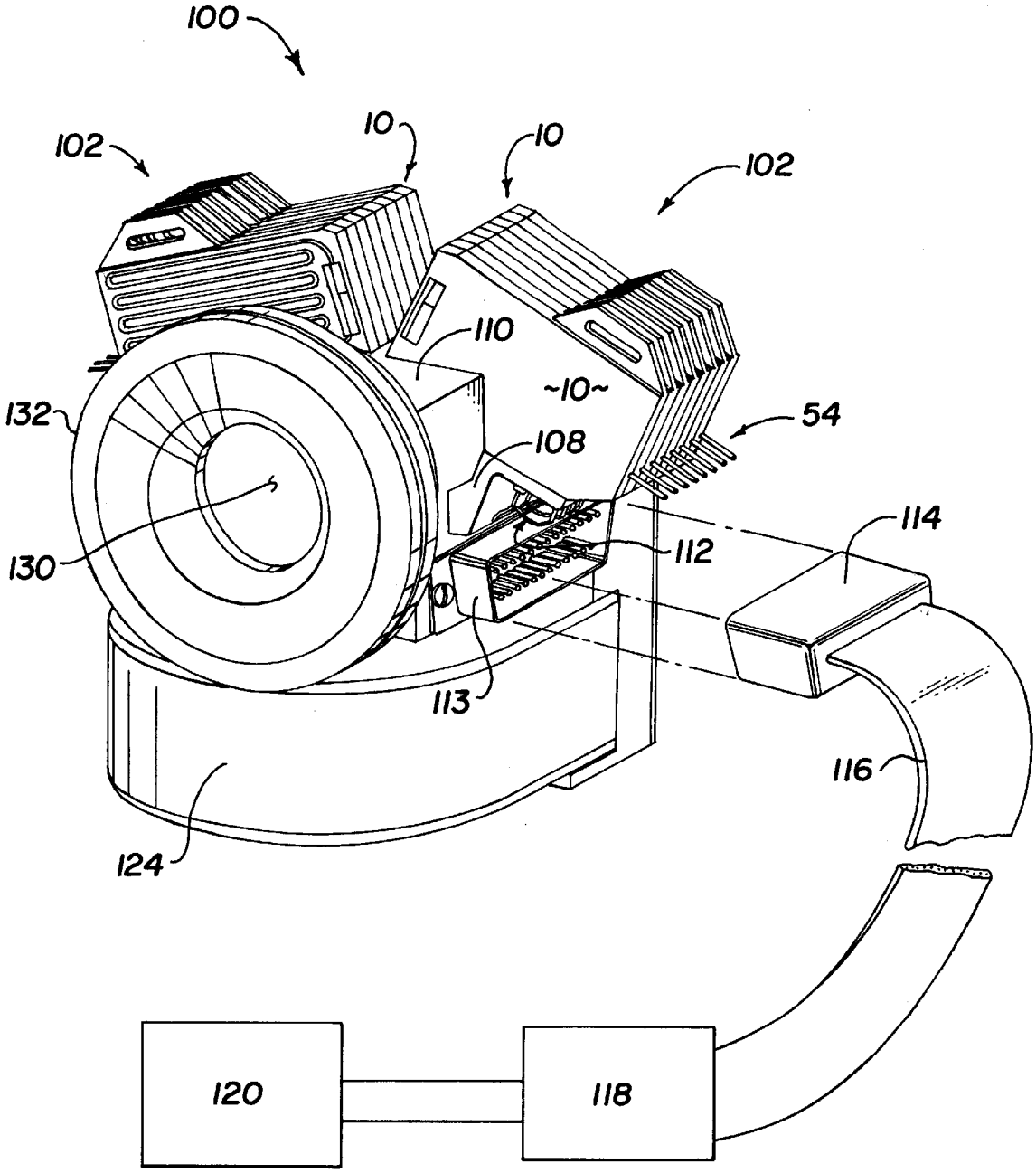
FIG. 6 is a perspective view of a self-contained assembly illustrating how the replaceable cartridges are employed to create a compact fluid dispensing device.
Figures 7, 8:
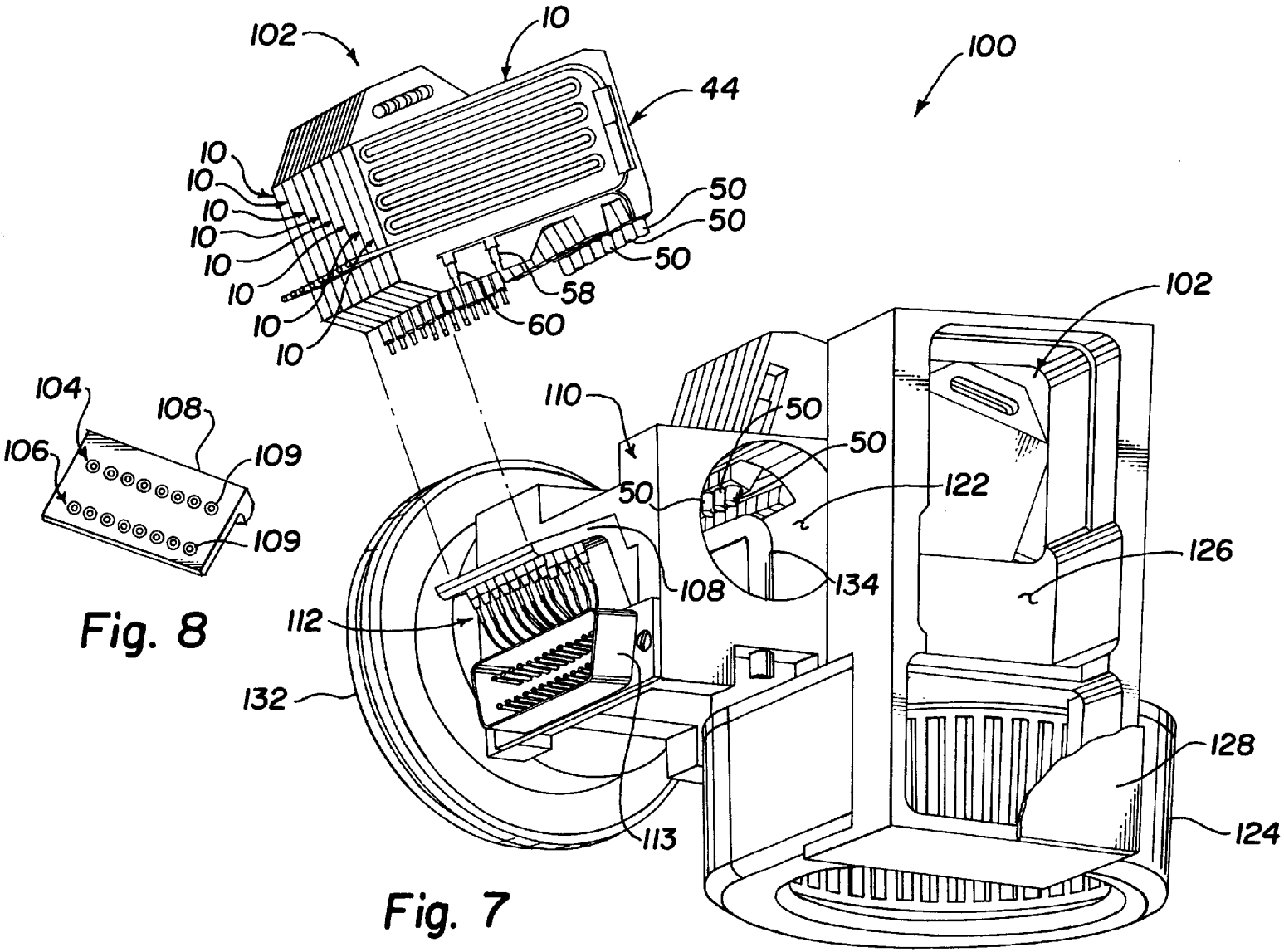
FIG. 7 is an exploded and perspective view of the compact multi-fluid dispensing device of FIG. 6 illustrating how a plurality of replaceable cartridges can be arranged in banks to make the compact multi-fluid dispenser.
FIG. 8 illustrates one version of a connecting strip having paired sockets in the form of closely spaced dual in line sockets into which the individual replaceable cartridge bodies are plugged for easy installation, removal and replacement.

FIGS. 6 and 7 disclose an assembly 100 of replaceable cartridges for micro jet dispensing of multiple fluids in a compact assembly made possible by the unique replaceable cartridges 10 or 78. The assembly of FIGS. 6 and 7 rely upon the particular configuration of replaceable cartridge 10 of FIG. 3, however with suitable modification of the connections, the modified embodiment of FIG. 5 could be employed in a compact assembly of FIGS. 6 and 7 also. FIG. 8 shows one version of a connector strip having dual in line connecting sockets of a convention dual-in-line packaging device which is preferred for use with the replaceable cartridge 10 of FIG. 3.

FIGS. 6 and 7 show a pair of separate banks 102 comprising eight aligned replaceable cartridges 10 in close side by side arrangement. Each replaceable cartridge 10 has the embedded ejection device 44 and an extending tip portion 50 of device 44 together with the connecting pins 58 and 60. Connecting pins 58 and 60 are configured to plug into dual in line sockets which are arranged in rows 104 and 106 of connector strip 108. The fixed connecting pins 58, 60 preferably provide mechanical support for each of the individual replaceable cartridges 10 in the banks 102.

FIG. 7 is a partially exploded view of the compact assembly 100. A connecting strip 108 for each of the banks 102 of replaceable cartridges 10 are mounted onto a housing 110. Connecting wires 112 run from each of the individual sockets 109 in the rows of sockets 104, 106 in connector strip 108 which are connected to individual pins in an input socket 113. Referring now to FIG. 6, socket 113 is removably engageable with a companion socket 114. When companion socket 114 is plugged into input socket 113, a ribbon connector 116 is in electrical contact with a pulse generator/relay bank combination 118 which in turn is connected to a programmed computer 120 having a digital output card along with appropriate power supplies as is conventional for controlling and driving ink jet printing devices.

The pair of connecting pins 58, 60 of each of the eight replaceable cartridges 10 in each bank of replaceable cartridges 102 are removably connected in electrical contact with one of the sockets 104, 106 in connector strip 108. Each individual cartridge 10 is removably replaceable simply by pulling it out to disconnect it and pushing another cartridge into its place.

Returning now to FIGS. 7 and 8, it can be seen that housing 110 contains a chamber 122 and the ejection orifices 52 of tip portions 50 are positioned to eject droplets of fluid into chamber 122. A blower or fan 124 connected to housing 110 comprises a means for moving air through a passageway 126 through chamber 122 where it exits through an outlet 130 in a cone shaped extension 132 in housing 110. It can be seen that two banks of cartridges 102 are separated from each other and disposed in radial orientation with respect to the chamber 122 so that all of the orifices are able to eject micro-droplets of fluid into chamber 122. This is somewhat like the arrangement of cylinders in a "V8" automobile engine or a radial airplane engine. It can be seen that this structure could be altered so that one or more additional banks 102 of replaceable cartridges could be arranged in radial orientation to deposit micro-droplets into the chamber 122.

Referring now to FIG. 7, a heater 134 having a heatable surface is preferably mounted in chamber 122 and provided with electrical connections through the connector 113. Heater 134 is mounted such that each of the ejection orifices 52 of the digitally operated ejection devices 44 of replaceable cartridges 10 are positioned to deposit micro-droplets onto the heatable surface of heater 134. Heater 134 can be left on to keep the heatable surface at an elevated temperature for instant vaporization of droplets deposited thereon or it can be switched on when a dispensing cycle is about to be initiated. These devices are very small and the heatable surface is preferably a very rapidly heatable surface because the compact assembly 100 and the replaceable cartridges are very small and do not have much mass. The heatable surface of heater 134 should be wettable with the fluids deposited thereon. Both the heatable surface of heater 134 and the heater 88 can be provided by what is known as a surface mount resistor or platinum RTD. Surface mount resistors are thin film resistors available commercially which have low mass and low power requirements and are inexpensive. Surface mount resistors are available from Newark Electronics, East Brunswick, N.J. or Dallas, Tex. and the RTD's from Omega Engineering, Stamford, Conn.

In the best mode, the micro jet dispensing device is a piezoelectric device and the reservoir 54 is capillary tubing. The use of capillary tubing eliminates the necessity of static head pressure control at the orifice of the piezoelectric device, greatly simplifying the general construction of the device and improving its reliability. Thus, the device can be operated in any orientation without concern about loss of "head". Alternately, the reservoir can be shaped in any way, as long as it is kept close to the micro-droplet ejection device so that pressure at the orifice is close to that at the end of the tubing. The reservoir 54 may be filled by means of a fine needled syringe through the opening 56. The tubular reservoir is first evacuated with a syringe. The cartridge body is preferably made from plastic material and contains all parts of the replaceable cartridge.

The rubber plug 68 in the ejection device is preferably silicon rubber. The capillary tubing in a prototype is identified as PTFE 30 TW tubing from Cole Parmer Instrument Co., Vernon Hills, Ill., having an outer diameter of 0.031 inches and an inner diameter of 0.012 inches. The polycarbonate material Lexan works well for the cartridge body.

The orifice of the ejection device would typically be in the range of about 30 to 70 microns in diameter in a nickel orifice tube plate. In an exemplary embodiment, the capillary tubing mentioned above has a length of 600 millimeters, producing a reservoir volume of about 45 microliters. The micro-droplets have a volume of about 50 to 100 picoliters. If one "shot" requires 50 of those droplets, one could expect the total number of "shots" before the reservoir was depleted would be in the range of about 17,000 to about 8500.

Of particular importance is the ability to use conventional dual in line packaging or "DIP" sockets which are standardized for use in computer assembly. They have a 0.3 inch spacing between rows with a 0.1 inch spacing within rows from socket to socket. The thickness of the thin panel in a prototype was made to be not more than about 0.095 inches thick which permits side by side installation of the replaceable cartridges in standard "DIP" sockets.

Although the preferred embodiment is illustrated with depressions for the tubular fluid reservoir, ejection device, connecting pins and wiring channels in only one side surface of the cartridge body, it is evident that some of the depressed areas could be in one side of the body while others were in the other side surface of the body.

Although the invention has been disclosed above with regard to a particular and preferred embodiment, it is not intended to limit the scope of the invention. For instance, although the inventive method has been set forth in a prescribed sequence of steps, it is understood that the disclosed sequence of steps may be varied. It will be appreciated that various modifications, alternatives, variations, etc. may be made without departing from the spirit and scope of the invention as defined in the appended claims.

What is claimed:

1. A replaceable cartridge for microjet dispensing assemblies, comprising:

a cartridge body comprising a thin panel having opposed side surfaces substantially larger than its thickness wherein said side surfaces define an outwardly facing peripheral edge between them;

a digitally operated micro-droplet ejection device carried by the cartridge body, the ejection device having an ejection orifice facing outwardly with respect to the peripheral edge;

an elongated tubular fluid reservoir carried by the cartridge body and connected in fluid communication with the ejection device;

a pair of fixed connecting pins carried by the body in electrical operating contact with the ejection device, each connecting pin extending from the body and being configured for engagement and disengagement with one of a pair of dual in line sockets in a connector strip having a plurality of closely spaced dual in line sockets; and wherein the connecting pins of the cartridge can be quickly plugged into and unplugged from said one of a pair of closely spaced dual in line sockets which receive the connecting pins and support the cartridge to make a closely packed assembly of replaceable dispensers.

2. The replaceable cartridge of claim 1 further including a heater supported by the cartridge body in front of and spaced from the ejection orifice.

3. The replaceable cartridge of claim 2 wherein the heater is mounted to the cartridge body by means of a stand-off strip adjacent to the ejection orifice.

4. The replaceable cartridge of claim 2 further including a pin fixed to the cartridge body in electrical operating contact with the heater and being positioned to quickly plug into or be unplugged from one of a plurality of closely spaced sockets.

5. The replaceable cartridge of claim 1 wherein the elongated tubular fluid reservoir is in the form of an elongated capillary tube.

6. The replaceable cartridge of claim 5 wherein said elongated capillary tube is disposed in a serpentine channel formed in a side surface of the cartridge body.

7. The replaceable cartridge of claim 6 wherein the pair of fixed connecting pins and the digitally operated micro-droplet ejection device are embedded in the cartridge body.

8. The replaceable cartridge of claim 7 wherein a thin cover is provided over the side surface of the cartridge body to protect the operating parts.

9. The replaceable cartridge of claim 7 wherein a heater is supported by the cartridge body in front of the ejection orifice to receive micro-droplets ejected therefrom and the cartridge body has at least one additional connecting pin embedded in the body and connected to the heater to provide electrical power for operation of the heater.

10. The replaceable cartridge of claim 9 wherein the heater comprises a surface mounted resistor.

11. The replaceable cartridge of claim 6 wherein a side surface of the body contains a recess in which the digitally operated ejection device is mounted below said side surface.

12. The replaceable cartridge of claim 6 wherein a side surface of the body has a pair of spaced apart pin receiving slots in which said pair of fixed connecting pins are mounted below said side surface.

13. The replaceable cartridge of claim 12 further including a channel in a side surface of the cartridge body for electrical wires running between the fixed connecting pins and the digitally operated micro-droplet ejection device.

14. An assembly of replaceable cartridges for micro-jet dispensing of fluids, the assembly comprising:

at least one connecting strip having a plurality of closely spaced dual in line connecting sockets;

a plurality of cartridge bodies comprising thin panels, each having opposed side surfaces substantially larger than the thickness of the cartridge body panel, and an outer peripheral edge;

each cartridge body having:

a digitally operated micro-droplet ejection device having an ejection orifice;

a tubular fluid reservoir connected in fluid communication with the ejection device;

a pair of connecting pins fixed to the cartridge body panel, in electrical operating contact with the ejection device, the connecting pins being configured to be received in one of the dual in line connecting sockets of the at least one connecting strip;

the plurality of cartridges being supported on the at least one connection strip in close side by side relation by the connecting pins on each cartridge being received in one of the closely spaced in line dual connecting sockets in electrical contact therewith; and wherein any of the plurality of cartridges can be quickly replaced by working its connecting pins free of the dual in line sockets in the connecting strip and plugging the connecting pins of another cartridge into the same dual in line connecting sockets.

15. The assembly of cartridges according to claim 14, wherein each cartridge body has a channel formed in a side surface in which the tubular fluid reservoir is disposed.

16. The assembly of cartridges according to claim 15, wherein a side surface of each body contains a recess in which the digitally operated ejection device is mounted below said side surface.

17. The assembly of cartridges according to claim 16, wherein a side surface of each body has a pair of spaced apart pin receiving slots in which said pair of fixed connecting pins are mounted below said side surface.

18. The assembly of cartridges according to claim 17 further including a channel in a side surface of each cartridge body for electrical wires running between the fixed connecting pins and the digitally operated micro-droplet ejection device.

19. The assembly of cartridges according to claim 18 wherein the plurality of cartridge bodies comprise a first bank of cartridges and a second bank of cartridges and wherein the first and second bank of cartridges are mounted on a housing containing the chamber and wherein both banks of cartridges are aimed to deposit droplets of fluid into said chamber.

20. The assembly of cartridges according to claim 17 further including a heater having a heatable surface wherein the plurality of cartridge bodies are mounted on the at least one connecting strip adjacent the heatable surface with the ejection orifices positioned to eject droplets of fluid onto the heatable surface whereby fluid droplets deposited on the heatable surface may be rapidly volatilized.

21. The assembly of cartridges according to claim 20 wherein the heater having a heatable surface comprises a surface mounted resistor.

22. The assembly of cartridges according to claim 20 further including a chamber wherein the plurality of cartridge bodies are mounted on the at least one connecting strip adjacent the chamber and the ejection nozzles are positioned to eject droplets of fluid into the chamber.

23. The assembly of cartridges according to claim 22 wherein the chamber has a heatable surface and the ejection orifices are positioned to eject droplets of fluid onto the heatable surface.

24. The assembly of cartridges according to claim 23 wherein the heatable surface comprises a surface mounted resistor.

25. The assembly of cartridges according to claim 20 wherein the heatable surface is contained in a chamber and said ejection orifices are positioned to eject droplets of fluid into the chamber and onto the heatable surface.

26. The assembly of cartridges according to claim 25 wherein the plurality of cartridge bodies comprise a first bank of cartridges and a second bank of cartridges and wherein the first and second bank of cartridges are mounted on a housing containing the chamber and heatable surface and wherein both banks of cartridges are aimed to deposit droplets of fluid onto said heatable surface.

27. The assembly of cartridges according to claim 26 wherein the first and second bank of cartridges are separated and in a radial orientation with respect to the chamber.

28. The assembly of cartridges according to claim 27 wherein the housing is provided with a blower which moves air through the chamber.

29. The assembly of cartridges according to claim 28 wherein the first and second bank of cartridges are separated and in a radial orientation with respect to the chamber.

30. The assembly of cartridges according to claim 29 wherein the housing is provided with a blower which moves air through the chamber.

* * * * *